US005671814A

United States Patent [19]

Smith

[11] Patent Number: 5,671,814

[45] Date of Patent: Sep. 30, 1997

[54] FLAG INSERT TOOL

[76] Inventor: Eric C. Smith, 307 E. Van Buren St., Columbia City, Ind. 46725-6771

[21] Appl. No.: 566,034

[22] Filed: Dec. 1, 1995

[51] Int. Cl.[6] ..... B25D 1/16

[52] U.S. Cl. ..... 173/91; 173/90

[58] Field of Search ..... 173/90, 91

[56] References Cited

U.S. PATENT DOCUMENTS

| | | | |
|---|---|---|---|
| 1,646,039 | 9/1927 | Murton . | |
| 2,300,813 | 11/1942 | Savage | 173/90 |
| 2,475,041 | 7/1949 | Mattson | 173/91 |
| 2,622,781 | 12/1952 | Polson | 173/91 |
| 2,934,984 | 5/1960 | Woodman | 173/91 |
| 2,941,429 | 6/1960 | Mason | 173/91 |
| 3,060,257 | 2/1962 | Spurgeon . | |
| 3,113,478 | 12/1963 | Hall, Jr. et al. | 173/91 X |
| 3,381,763 | 5/1968 | Matson | 173/91 |
| 3,529,497 | 9/1970 | Brooks | 173/91 |
| 3,568,657 | 3/1971 | Gue | 173/91 X |
| 3,570,289 | 3/1971 | Smyers | 173/91 X |
| 3,700,196 | 10/1972 | Hall | 248/44 |
| 4,261,424 | 4/1981 | Gonterman et al. | 173/91 |
| 4,405,005 | 9/1983 | Zanker | 173/90 X |
| 4,688,969 | 8/1987 | Bruser et al. | 405/303 |
| 5,024,551 | 6/1991 | Hinterholzer | 404/10 |
| 5,025,867 | 6/1991 | Muller | 173/90 |
| 5,165,663 | 11/1992 | Wells | 256/19 |
| 5,396,743 | 3/1995 | Bellette | 52/154 |
| 5,495,878 | 3/1996 | McKenen, Jr. | 144/195.5 |

FOREIGN PATENT DOCUMENTS

| | | |
|---|---|---|
| 844813 | 6/1970 | Canada . |
| 2645574 | 10/1990 | France . |
| 4007259 | 11/1990 | Germany . |
| 3-183821 | 8/1991 | Japan . |
| 1182118 | 9/1985 | U.S.S.R. . |
| 480912 | 3/1938 | United Kingdom . |

*Primary Examiner*—Joseph J. Hail, III
*Assistant Examiner*—Jay A. Stelacone
*Attorney, Agent, or Firm*—Richard C. Litman

[57] ABSTRACT

This invention is a tool for either inserting the stem of a flag or marker in soil or rocky terrain or providing a hole therein of sufficient size to receive the stem of a flag. The tool is made up of three main components, these being an inner rod, an outer pipe and a pair of collars attached near the ends of the inner rod. The outer pipe is positioned between the two collars. The inner rod is notched on one end to facilitate inserting the tool. To insert the flag, the user places a bend in the flag stem and then places the stem inside the notch. By pounding down on the lower collar (which is attached to the inner rod) with the outer pipe the notched end and flag stem are driven into the ground. When the flag has been inserted to a desired depth, the tool is extracted leaving the flag inserted in the ground. Alternatively, to insert the flag the tool is used to create a hole of sufficient size wherein the flag is then inserted.

4 Claims, 3 Drawing Sheets

FLAG INSERT TOOL

BACKGROUND OF THE INVENTION

1. Field of the Invention

The present invention relates generally to a flag insert tool. More specifically, the invention relates to a tool for inserting the stem of a flag or marker in soil or rocky terrain.

2. Description of the Prior Art

Many types of workers (eg. surveyors, cable TV installers and utility company employees) use flag markers for flagging their work areas or facilities. These flag markers must be inserted in all types of soil and rocky terrain. Usually there are numerous flag markers placed in one general area. Valuable time is wasted due to cumbersome and heavy flag insert tools. There is therefore a need for a lightweight portable tool that will effectively insert flag markers into the soil in a quick and efficient manner. The present invention provides such a device.

Flag insert tools have been described in the patent literature. For instance, U.S. Pat. No. 1,646,039 issued to Murton on Sep. 6, 1923 describes a post driver but does not disclose any teaching of a notched inner rod dimensioned and configured to receive a flag, an upper collar attached to the inner rod, or an outer pipe hollow throughout.

U.S. Pat. Nos. 5,165,663 issued to Wells on Nov. 24, 1992 and 4,688,969 Bruser et al. on Aug. 25, 1987 describe ground installation devices but do not disclose a flag insertion device having a notched inner rod or a lower collar attached to the inner rod.

U.S. Pat. Nos. 5,024,551 issued to Hinterholzer on Jun. 18, 1991 and 3,060,257 issued to Spurgeon on Oct. 23, 1962 and German Pat. No. 4,007,259 issued November 1990 fail to disclose a tool having an inner rod with a notched end and an outer hollow pipe.

U.S. Pat. Nos. 5,396,743 issued to Bellette on Mar. 14, 1995 and 3,700,196 issued to Hall on Oct. 24, 1972, United Kingdom Pat. Specification No. 480,912 issued March 1938, Canadian Pat. No. 844,813 issued June 1970, Soviet Union Pat. No. 1,182,118 issued September 1985, French Pat. No. 2,645,574 issued October 1990 and Japanese Pat. No. 3-183821 issued August 1991 all describe ground support or anchor devices.

None of the above inventions and patents, taken either singly or in combination, is seen to describe the instant invention as claimed.

SUMMARY OF THE INVENTION

The present invention relates to a flag insert tool dimensioned and configured to either drive the stem of a flag marker into the ground or create a hole of sufficient size to receive a flag. The tool comprises an outer pipe that is in a sliding relationship with an inner rod. The outer pipe or driver is moveable in an upward and downward motion between an upper collar and a lower collar. The two collars are attached to the inner rod.

When the tool is used to drive the flag marker into the ground the bottom of the flag stem is bent at an angle. The flag is then placed parallel to the tool and is retained at the bend by a notch at the bottom of the inner rod. Force is applied to drive the flag stem by lifting up and forcing down the outer pipe onto the lower collar, which by transmission of force, drives the inner rod and therefore the flag stem into the ground. When the desired depth is reached the tool is withdrawn and the flag is left inserted.

When the tool is used to create a hole for insertion therein of the flag marker the user drives the tool into the ground as discussed above. When sufficient depth is reached the user removes the tool and inserts the flag marker.

Accordingly, it is a principal object of the invention to provide a flag insert tool that either inserts a flag marker into the ground or creates a hole of sufficient size to receive the flag marker.

It is another object of the invention to provide a flag insert tool having an outer pipe and an inner rod.

It is a further object of the invention to provide a flag insert tool wherein the inner rod has a notch at the bottom.

Still another object of the invention is to provide a flag insert tool having two collars attached to the inner rod.

An additional object of the invention is to provide a flag insert tool wherein the collars have a loop attached thereto to facilitate transporting the tool.

It is again an object of the invention to provide a flag insert tool wherein the outer pipe is in a sliding relationship with the inner rod.

Yet another object of the invention is to provide a flag insert tool wherein the outer pipe is positioned and moveable between the two collars.

It is an object of the invention to provide improved elements and arrangements thereof in an apparatus for the purposes described which is inexpensive, lightweight, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features' consistently throughout the attached drawings.

DETAILED DESCRIPTION OF THE PREFERRED EMBODIMENTS

Figure 1:
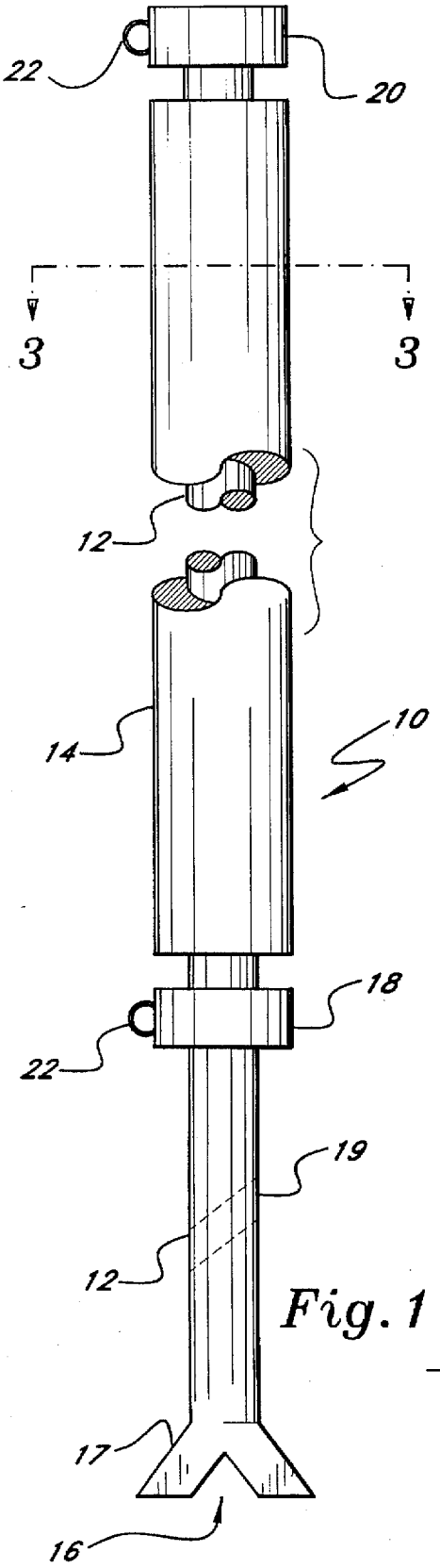
FIG. 1 is a front elevational view of the preferred embodiment.

Turning now to FIG. 1 of the drawings, the flag insert tool 10 has an outer pipe 14 and an inner rod 12. The outer pipe 14 and inner rod 12 are in a sliding relationship wherein the outer pipe 14 is positioned between an upper collar 20 and a lower collar 18. Attached to each collar is a loop 22. The loop 22 allows the user to tie a rope (not shown) to the loop 22 to aid in carrying the tool 10. To provide a secure attachment, the collars 18,20 are welded onto the inner rod 12.

Figure 2:
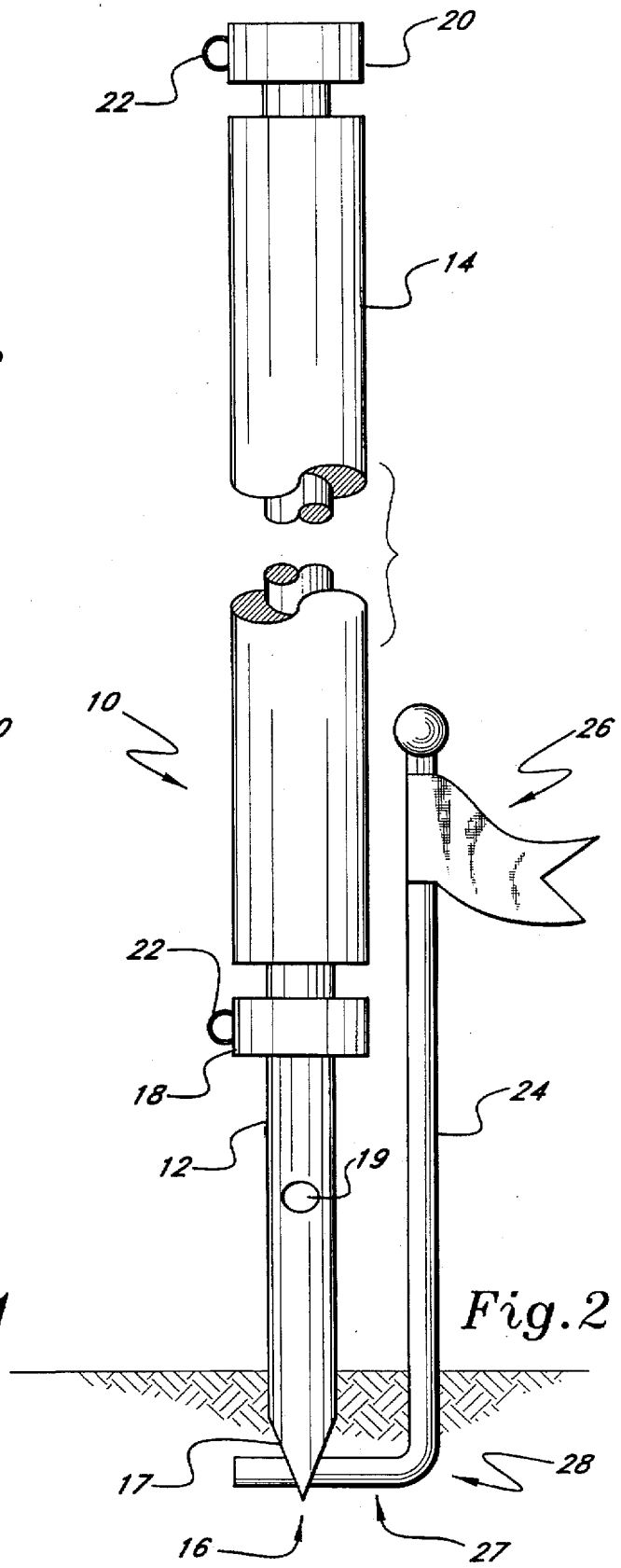
FIG. 2 is a right side elevational view of the preferred embodiment.

Located at the bottom of inner rod 12 is a flange 17 tapered to form a ground-penetrating edge. An inverted V-shaped notch 16 is formed in the ground-penetrating edge. Turning now to FIG. 2 of the drawings, the bottom of stem 24 of flag 26 is shown with a bend (seen generally at 28). Before using the tool 10, the user bends the stem 24 by placing stem 24 through cavity or aperture 19 and then exerts a force to bend the stem 24. The user then places the flag 26 parallel to the tool 10 and then places the horizontal section 27 of stem 24 in notch 16 of tool 10. With notch 16 holding the stem 24, the user first raises and then lowers outer pipe 14 onto lower collar 18. The force exerted onto lower collar 18 forces flange 17 and therefore flag 26 into the ground. When flag 26 has been driven to a desired depth the flag insert tool 10 is removed leaving the flag 26 inserted.

An alternative method to insert flag 26 into the ground includes using tool 10 to create a hole of sufficient size to receive flag 26. The hole is created by using outer pipe 14 to exert force on lower collar 18 as described above. When a hole of sufficient depth is made the user simply inserts flag 26 into the newly created hole.

Figure 3:
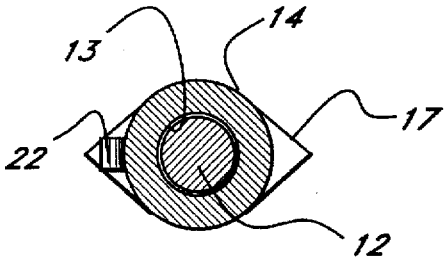
FIG. 3 is a cross-sectional view of the preferred embodiment.

FIG. 3 shows a cross section of the insert tool 10. Inner rod 12 and outer pipe 14 are shown in a sliding relationship with a small separation or gap 13 therebetween. The gap 13 allows the outer pipe 14 to slide easily between the upper and lower collars. If needed, any readily available lubricant (not shown) can be applied in the gap 13 to reduce any friction between the inner rod 12 and outer pipe 14.

Figure 4:
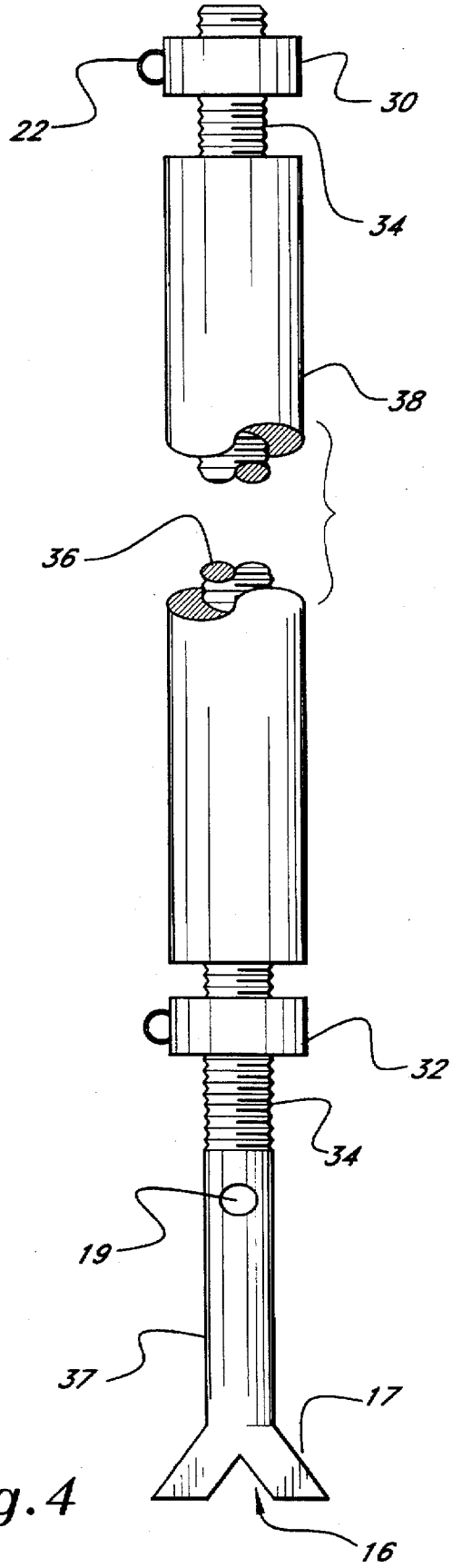
FIG. 4 is a front elevational view of the second embodiment.
Figure 5:
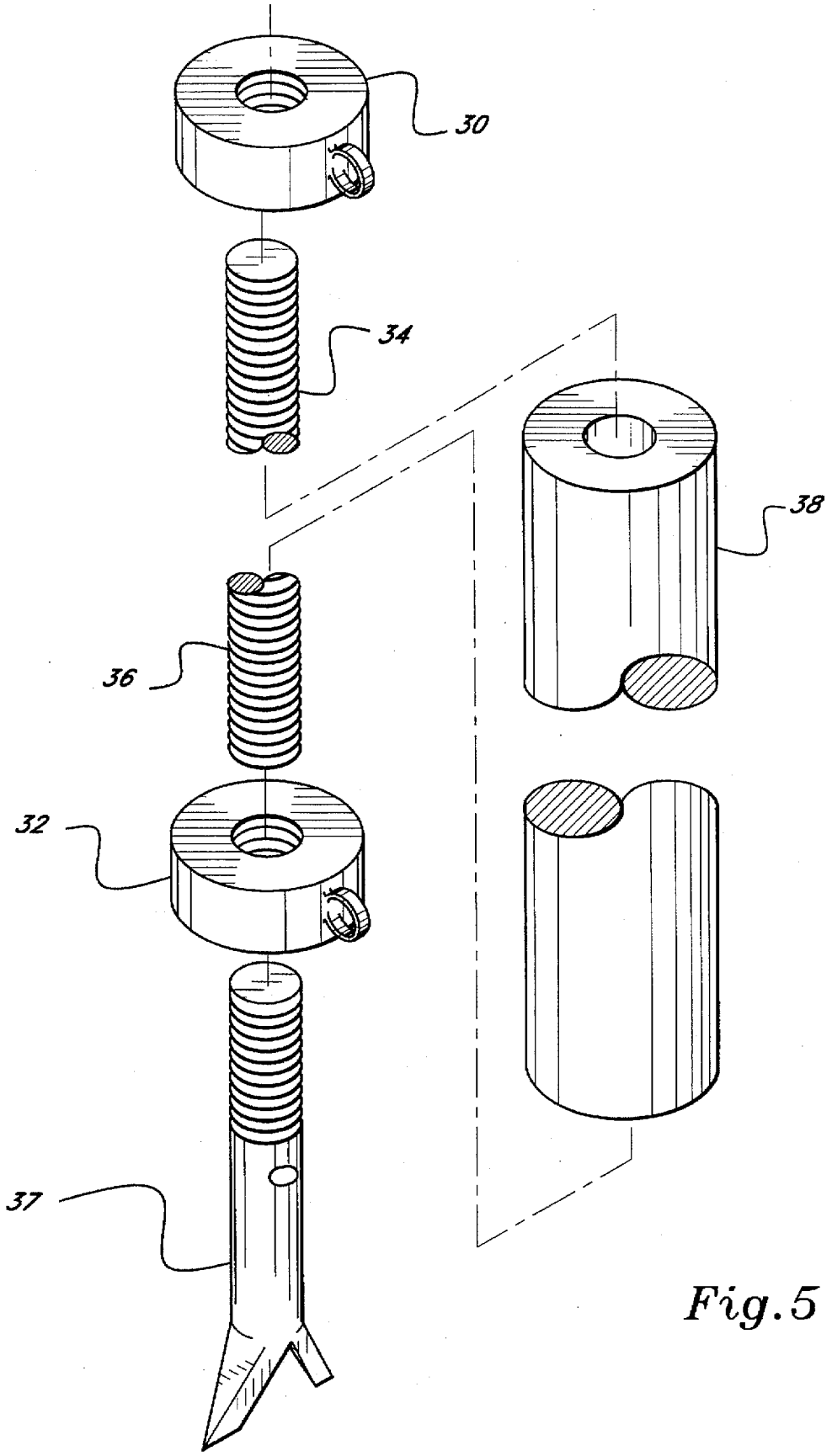
FIG. 5 is an exploded view of the second embodiment.

Turning now to FIGS. 4 and 5, a second embodiment of the present invention is shown. The upper collar 30 and coupler 32 are attached to the inner rod 36 via threads 34. Inner rod 36 is threaded throughout. Lower rod 37 attaches to inner rod 36 via coupler 32. To secure the upper collar 30 and coupler 32, the user screws the collar 30 and coupler 32 onto the inner rod 36 until secure. Any means of attachment would be appropriate; for instance, a cotter pin, nut and bolt, or snap fit attachments all could be used to attach the collars to the inner rod. To assemble the tool the user attaches coupler 32 to lower rod 37, then attaches inner rod 36 to coupler 32. Next outer pipe 38 is inserted over inner rod 36 and upper collar 30 is then secured to inner rod 36. At this point the user can insert the flag 26 into the soil by either of the methods discussed above.

It is to be understood that the present invention is not limited to the embodiments described above, but encompasses any and all embodiments within the scope of the following claims.

I claim:

1. A flag insert tool for inserting a flag having a stem into ground, the tool comprising:

an inner rod having a upper end and a lower end, said lower end terminating in a tapered ground-penetrating edge having an notch therein, said inner rod having an aperture passing therethrough proximate said lower end;

a first collar attached to said inner rod proximate said lower end;

a second collar attached to said inner rod proximate said upper end; and an outer pipe slidably disposed around said inner rod between said first collar and said second collar; whereby a flag stem is driven into ground by inserting the flag stem through said aperture, bending the flag stem to form a horizontal section, placing the horizontal section within said notch, placing said lower end on the ground and impinging said outer pipe against said first collar to drive the flag stem into the ground.

2. The flag insert tool according to claim 1, wherein said first collar and said second collar are welded to said inner rod.

3. The flag insert tool according to claim 9, wherein said inner rod is threaded at said lower end and at said upper end and wherein said first collar and said second collar are dimensioned and configured to thread onto said inner rod.

4. The flag insert tool according to claim 1, wherein said notch is dimensioned and configured to resemble an upside down V.

* * * * *